United States Patent [19]

Haws

[11] Patent Number: 4,518,007

[45] Date of Patent: May 21, 1985

[54] AUTOMATIC HOT WATER RECOVERY SYSTEM

[76] Inventor: Spencer K. Haws, P.O. Box 315, Mesa, Wash. 99343

[21] Appl. No.: 524,183

[22] Filed: Aug. 17, 1983

[51] Int. Cl.[3] ..... F16K 49/00; F24H 1/00

[52] U.S. Cl. ..... 137/337; 137/496; 126/362

[58] Field of Search ..... 137/337, 496; 126/362

[56] References Cited

U.S. PATENT DOCUMENTS 1,555,817 10/1925 Anderson ..... 137/496

3,108,611 10/1963 Ketler, Jr. ..... 137/496

4,286,573 9/1981 Nickel ..... 137/496

4,321,943 3/1982 Haws ..... 137/337

*Primary Examiner*—A. Michael Chambers

*Attorney, Agent, or Firm*—Townsend & Townsend

[57] ABSTRACT

A heat recovery system recovers hot water to an insulated tank through reciprocally variable volume chambers which are biased to draw water from hot water lines when the pressure throughout the system is equalized. One-way valving means permits continuous water flow when desired through the hot water tank to the hot water outlet. In a specific embodiment, bias is effected by a piston having opposing faces of unequal area forming reciprocally moving walls of the chambers.

9 Claims, 1 Drawing Figure

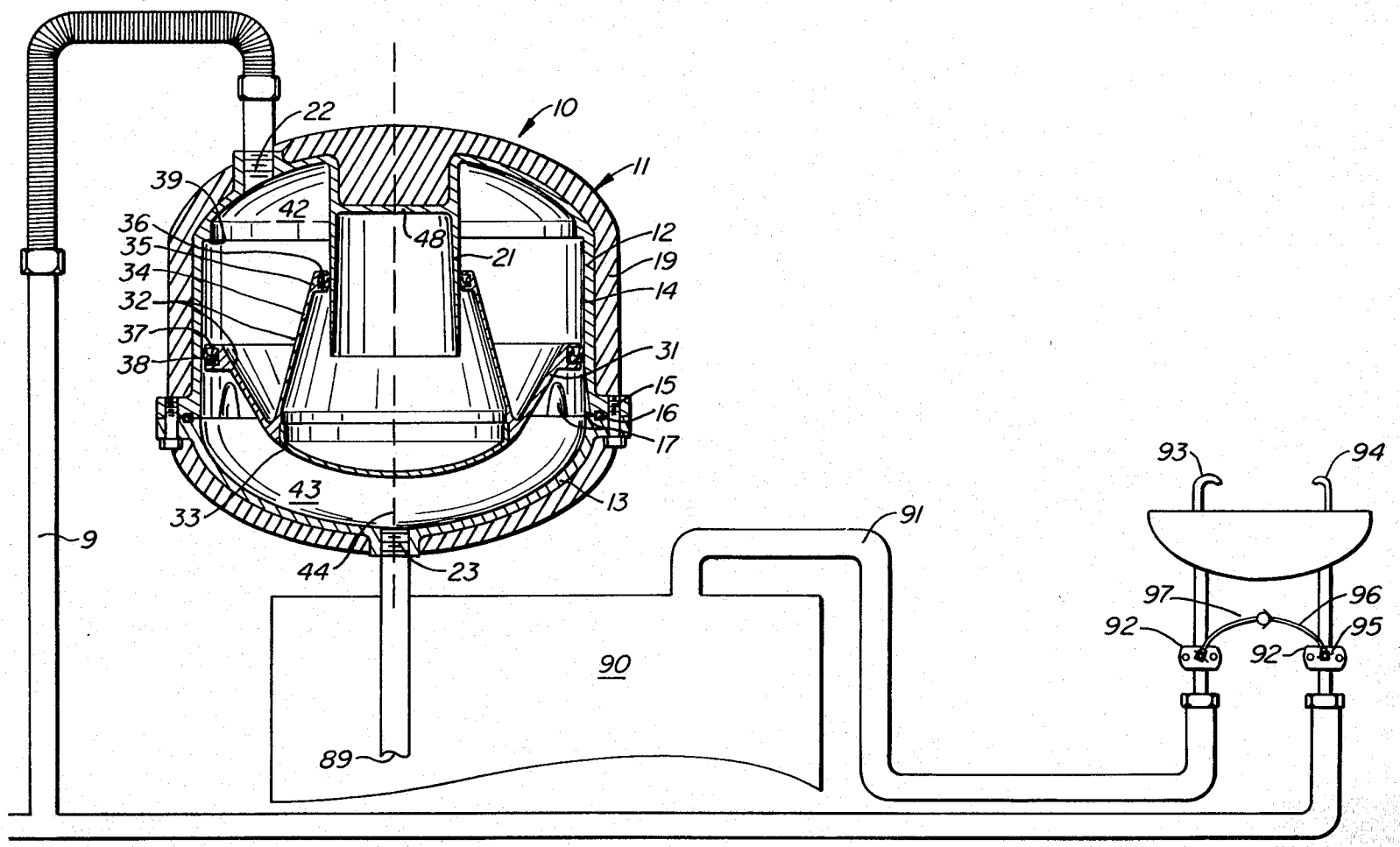
FIGURE

AUTOMATIC HOT WATER RECOVERY SYSTEM

BACKGROUND OF THE INVENTION

1. Field of the Invention

This invention relates to energy conservation, and particularly to recovering normally unused heat from domestic hot water pipes.

Most existing plumbing systems were designed without considering the present high cost of energy. Hot water is typically piped substantial distances from a heater tank to outlets, and after each use of hot water, heat remaining in the pipe water and walls dissipates and is lost. The pipes must be refilled with hot water for the next use. The water system in a typical home may use approximately one ounce of heating oil, one cubic foot of natural gas, or 250 watt-hours of electricity to heat a gallon of water, and waste as much as twenty-five gallons of hot water per day or nine thousand gallons per year. The increasing cost of energy makes it important to minimize the waste in heating water.

2. Description of the Prior Art

Insulation is the most common way to minimize heat loss in hot water lines, but heat is still lost at a rate depending upon the insulation.

An automatic hot water recovery system is disclosed in U.S. Pat. No. 4,321,943. That system uses a pressure reducer to lower the pressure in a water heater tank and hot water pipe when the hot water outlet is opened to below that of the associated water main and cold water pipe. A bridge conduit from the cold water pipe to the hot water pipe directs a slight flow of cold water from the higher pressure cold water pipe into the lower pressure hot water pipe. When the hot water outlet is closed, an air pocket in the heater tank works as a pneumatic spring to return hot water, and cold water displaces hot water otherwise left standing in the pipe back into the heater tank. The cold water backflow continues, transferring heat from the heated pipe walls into the tank, until the pressure in the tank rises to equal the pressure in the cold water main.

Although the prior art system works well, it depends upon pressure provided by the air pocket inside the heater, which requires some disassembly of the tank and installation of extra pipes.

SUMMARY OF THE INVENTION

According to the invention, a differential pressure reservoir is installed in the cold water supply line at the inlet of a water heater, and a bridge conduit is provided at the faucet between the hot water line and the cold water line to provide a cold water backflow in order to return unused hot water downstream of the water heater to the water heater. In a specific embodiment, the reservoir has a cylindrical interior enclosing a piston having first and second opposed faces of unequal area exposed towards first and second water chambers in opposite ends of the cylinder. All water entering the water heater intake flows through the differential pressure reservoir. Cold water from the main enters the first chamber in one end of the cylinder and exerts pressure against the smaller area first side of the piston. The larger area second side of the piston is hydraulically connected to the water heater intake. When a hot water outlet is opened, pressure drops in the heater tank, at its intake, and on the larger area second side of the piston, the piston moves to reduce the volume of the second chamber connected to the tank, and valving means opens (a passage is unblocked) allowing water from the cold water main to flow from the first chamber by the piston, through the second chamber, and the heater tank intake, for heating. When the hot water outlet at the faucet is closed and water pressures on the two sides of the piston are equal, the large effective area side is subjected to a greater total force, unbalancing and moving the piston. Hot water fills the increasing volume on the heater tank side of the reservoir, drawing water back through the hot water pipes from the bridge conduit, until the piston abuts against a shoulder stop inside the reservoir.

Hot water recovery is also aided by using an air spring to absorb the difference between changes in volumes of the first and second chambers. The spring is in air cavity which maintains the total volume of the reservoir constant while the water volume varies. It is typically near the same pressure as the water on both sides of the piston when the second chamber is fully expanded. Emptying the second chamber lowers pressure in the air cavity, which can be used effectively to draw hot water back into the heater tank.

The differential pressure reservoir functions over a wide range of water main pressures, allowing it to be used in low pressure water systems without causing a noticeable hot water pressure drop or requiring a compensating pressure adjustment. The only moving part in the reservoir, the piston, is enclosed, which minimizes the chances of leakage.

BRIEF DESCRIPTION OF THE DRAWING

The FIGURE shows a cross section of the reservoir cylinder and piston in connection with a bridge conduit in a hot water heater and plumbing system.

DETAILED DESCRIPTION OF THE PREFERRED EMBODIMENT

The present invention is a differential pressure reservoir 10 for use with a hot water system equipped with a bridge conduit 96 across the remote ends of each pair of hot and cold water pipes, as disclosed in U.S. Pat. No. 4,321,943, incorporated herein by reference. The invention combines the functions of, and replaces, the water heater air pocket and separate pressure reducing means of the prior art system.

Referring to the FIGURE, the differential pressure reservoir 10 is inserted between the cold water supply inlet 89 of a conventional water heater tank 90 and the cold water supply main 9. While the differential pressure reservoir 10 is shown in a retrofit embodiment for installation outside of heater tank 90, it is equally possible to install reservoir 10 without modification as original equipment inside of tank 90 between supply main 9 and inlet 89.

Differential pressure reservoir 10 comprises a casing 11 preferably formed from opposing hemispherical shells 12 and 13 which enclose a first cold water chamber 42 and a second hot water chamber 43, and a cylinder 14. Reservoir 10 preferably has a total water capacity of approximately 1.5 gallons. A covering of thermal insulation 19 such as styrofoam around the outside of casing 11 holds whatever heat enters the reservoir from the tank. Shells 12 and 13 are preferably mated by fasteners such as bolts 15, and sealed by an O-ring 16. Shell 12 has a port 22 connected to cold water supply main 9, and shell 13 has a port 23 connected to heater tank intake 89.

A double-sided piston 31 slides up and down along axis 44 in cylinder 14. The "effective" area of each side of piston 31 is that area normal to axis 44 and exposed to water. By any one of several arrangements, the piston's effective area is greater on the side under pressure from water tank 90 than on the side under pressure from cold water main 9. In the preferred embodiment, piston 31 has a semispherical portion with a first concave face 32 forming a movable wall of first chamber 42 and a second convex face 33 forming an opposing movable wall of second chambers 43. The first piston face 32 also includes the outer side of the base of a frusto-conical member 34 which extends and converges towards a notched inner rim 35 holding a U-cup seal 36. A hollow cylindrical sleeve 21 extends from the center of shell 12 part way along axis 44 and forms a sliding fit with U-cup seal 36. The volume of air trapped inside conical section 34 and sleeve 21 serves as an air spring. In a plane normal to axis 44, the effective area of first face 32 is less, by the area of the base 48 of sleeve 21, than the effective area of second face 33. Piston 31 has a notched outer rim 37 holding a U-cup seal 38 to keep water from leaking between cold water chamber 42 and hot water chamber 43, except when rim 37 is near the end of cylinder 14 adjacent grooves 17. The grooves 17 serve as a valve means to permit passage of water from inlet 9 across the piston to outlet 23 whenever the second face 33 is urged to a position approaching outlet 23.

Reservoir 10 is radially symmetrical around axis 44 of cylinder 14, with the exception of port 22 being off-center, fasteners 15, and cylinder wall grooves 17. The outside walls of the casing may be tapered for convenience in manufacturing with injection molded plastic such as Delrin ®, or other suitable material which will not corrode, scale, rust or pit, and which has a service temperature above 212° F. The cylinder walls should be non-abrasive to promote long seal life.

OPERATION

When the hot water system is in a standby state and no water, or at least no hot water, is flowing, pressures on both sides of piston 31 are equal. In the preferred embodiment, because the effective area of second face 33 is greater than that of first face 32, the total force on side 33 is greater and moves the piston to expand second chamber 43 until, at the top of the piston stroke, rim 37 abuts shoulder 39. The shoulder 39 should be in a plane normal to axis 44 so that when the hot water outlet 93 is closed, the upward pressure on piston 31 will be distributed equally around shoulder 39.

When hot water outlet 93 is opened, hot water flows out of pipe 92 from tank 90, reducing the pressure at tank intake 89 and in second chamber 43 relative to first chamber 42. When the total force on second face 33 is less than that on first face 32, hot water flows out, and second chamber 43 contracts. When piston 31 moves down to the level where rim 37 is adjacent cylinder wall grooves 17, cold water from first chamber 42 flows through the grooves and on into tank 90. Grooves 17 serve as valve means to allow water to flow by without rolling U-cup seal 38 off of piston 31.

When hot water outlet 93 is closed, the slight flow of cold water through cross-over conduit 96 will raise the pressure in hot water pipe 91 to that of cold water pipe 9. This changes the pressure differential to a force differential in the opposite direction, which pushes away piston 31 and enlarges second chamber 43, as explained above. Bridge conduit 96 contains a one-way flow-check valve 97 which prevents hot water from entering cold water pipe 9. The bridge conduit 96 is connected between pipes adjacent outlet faucets 93 and 94 with clamp-on-copper-piercing needle valves 92 and 95 which can be adjusted to control the rate of back flow, and thus the rate at which the system functions.

Details have been disclosed to illustrate the invention in a preferred embodiment of which adaptations and modifications within the spirit and scope of the invention will occur to those skilled in the art. For example, the reservoir according to the invention could be mounted anywhere in the water line near the water heater, including on the outlet side of the water heater, to serve as a hot water recovery and storage mechanism. The scope of the invention is therefore limited only by the following claims.

What is claimed is:

1. A differential pressure reservoir for recovering heat from a hot water system having a backflow of cold water for forcing hot water into a water heater, comprising:

a casing enclosing a cylindrical interior end having first and second water ports for inlet and outlet of water;

a piston slidingly disposed in the cylindrical interior between said first and second water ports and having first and second faces, said first face having an effective area for exposure to water pressure which is smaller than the effective area of said second face, said piston dividing said cylindrical interior into first and second chambers, whereby movement of the piston along a central axis of the cylindrical interior changes the volume of the second chamber formed by said second face of the piston with the larger effective area more than the volume of the first chamber formed by said first face with the smaller effective area; and valve means for allowing water to flow from the first chamber to the second chamber when the piston is in a position to minimize the volume of the second chamber on the side of the piston with the larger effective area;

said reservoir for mounting in the cold water inlet conduit of said water heater.

2. A reservoir as in claim 1 wherein said piston is in pneumatic communication with a variable volume gas cavity within said casing, said gas cavity being disposed adjacent said first face.

3. A reservoir as in claim 2 wherein said gas cavity is formed by a cylindrical wall concentric to and having a diameter less than said casing and depending from said casing within said first chamber, and wherein a margin of said first face of said piston mates in a sliding fit with said cylindrical cavity wall.

4. The pressure reservoir according to claim 1 wherein said second face defines a convex surface generally conforming to an opposing wall of said second chamber.

5. The pressure reservoir according to claim 1 wherein said valve means comprise grooves around the wall of said cylindrical interior, said grooves bridging between said first and second chambers when said second chamber is in a minimum volume position.

6. In a plumbing system having a first cold water inlet conduit for coupling to a pressurized water main, a hot water heater tank coupled to receive cold water from said sold water inlet conduit and to supply hot water to a first outlet means, a second cold water inlet conduit coupled between said pressurized water main and a second outlet means, and bridge conduit means coupling said second cold water conduit and said hot water conduit adjacent said first and second outlet means, the improvement comprising:

a reservoir for mounting between said first outlet means and said water main in the path of heated water;

first and second chamber means for storing water within said reservoir;

piston means for inversely varying the volume of said first chamber means relative to the volume of said second chamber means;

means for biasing said volumes between said first and second chambers to draw water into said second chamber from said first outlet means when said first and second chambers are at nominally equal pressures; and means for valving water from said first chamber to said second chamber upon the drawing of water at said first outlet means.

7. The improvement of claim 6 wherein the reservoir is insulated against heat loss.

8. The improvement of claim 6 wherein said volume varying means comprises a piston and wherein said biasing means comprises first and second opposing piston faces of unequal effective area for engaging water, said piston forming reciprocally moving walls.

9. The improvement of claim 8 wherein said biasing means further comprises means forming a variable volume gas chamber within said reservoir.

* * * * *